US008272722B2

(12) United States Patent
Iijima

(10) Patent No.: US 8,272,722 B2
(45) Date of Patent: Sep. 25, 2012

(54) INK CARTRIDGES, INK SUPPLY SYSTEMS, AND IMAGE RECORDING APPARATUS

(75) Inventor: Shota Iijima, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1071 days.

(21) Appl. No.: 12/184,222

(22) Filed: Jul. 31, 2008

(65) Prior Publication Data

US 2009/0033726 A1 Feb. 5, 2009

(30) Foreign Application Priority Data

Jul. 31, 2007 (JP) ..... 2007-199000

(51) Int. Cl.
*B41J 2/175* (2006.01)

(52) U.S. Cl. ..... 347/86

(58) Field of Classification Search ..... 347/84–86
See application file for complete search history.

(56) References Cited

U.S. PATENT DOCUMENTS 7,325,912 B2 * 2/2008 Lewey et al. ..... 347/86
7,334,889 B2 2/2008 Sasaki et al.

FOREIGN PATENT DOCUMENTS

JP 2000135796 A 5/2000
JP 2003300330 A 10/2003
JP 2005238576 A 9/2005

* cited by examiner

*Primary Examiner* — Matthew Luu
*Assistant Examiner* — Renee I Wilson
(74) *Attorney, Agent, or Firm* — Baker Botts L.L.P.

(57) ABSTRACT

An ink cartridge includes a case defining an ink chamber therein, in which the ink chamber is configured to store ink therein, and the case comprises a particular wall having an opening formed therethough. The ink cartridge also includes an ink supply portion configured to dispense ink from an interior of the ink chamber to an exterior of the ink chamber, and a sealing portion positioned at the particular wall. A predetermined portion of the sealing portion is configured to selectively cover a first portion of the opening. Moreover, the ink cartridge includes a protrusion positioned at the particular wall, in which the protrusion is configured to selectively cover a second portion of the opening, and a predetermined portion of the protrusion is configured to be selectively connected to the predetermined portion of the sealing portion. When a predetermined amount of force is applied to the protrusion in a predetermined direction the protrusion is configured to move from a first position in which the predetermined portion of the protrusion is connected to the predetermined portion of the sealing portion to a second position in which the predetermined portion of the protrusion is separated from the predetermined portion of the sealing portion to uncover at least a portion of the second portion of the opening.

24 Claims, 9 Drawing Sheets

INK CARTRIDGES, INK SUPPLY SYSTEMS, AND IMAGE RECORDING APPARATUS

CROSS REFERENCE TO RELATED APPLICATION

The present application claims priority from Japanese Patent Application No. 2007-199000, which was filed on Jul. 31, 2007, the disclosure of which is incorporated herein by reference in its entirety.

BACKGROUND OF THE INVENTION

1. Field of the Invention

The present invention relates generally to ink cartridges, ink supply systems, comprising such ink cartridges, and to an image recording apparatus comprising such ink supply systems. More specifically, the present invention is directed towards ink cartridges, ink supply systems, and image recording apparatus in which the inside of such ink cartridges is bought into air communication with the atmosphere to reliably supply ink from the ink cartridge to the image recording apparatus.

2. Description of Related Art

A known inkjet image recording apparatus is configured to feed a recording medium, e.g., a sheet of paper. The inkjet image recording apparatus includes a carriage configured to reciprocate in a direction perpendicular to a direction in which the recording medium is fed, and a recording head mounted on the carriage. The recording head includes a plurality of nozzles through which ink droplets are ejected toward a recording medium to form a desired image on the recording medium. A known ink cartridge is configured to be removably mounted to the known inkjet image recording apparatus. The known ink cartridge includes an ink chamber configured to store ink therein, and an ink supply portion. When the known ink cartridge is mounted to the inkjet image recording apparatus, ink is supplied from the ink chamber to the recording head via the ink supply portion.

Known inkjet image recording apparatus may include an on-carriage-type apparatuses or an off-carriage-type apparatus. The on-carriage-type inkjet recording apparatus includes a case having a mounting portion on which the ink cartridge is removably mounted. The case is positioned on the carriage. When the ink cartridge is mounted on the mounting portion of the case, ink is supplied from the ink cartridge to the recording head. The off-carriage-type inkjet recording apparatus includes a case positioned in a portion of the inkjet recording apparatus other than the carriage. The case includes a mounting portion on which the ink cartridge is removably mounted. The off-carriage-type inkjet recording apparatus further includes a tube connected to the case and the recording head. When the ink cartridge is mounted on the mounting portion of the off-carriage-type inkjet recording apparatus, ink is supplied from the ink cartridge to the recording head via the tube.

If gas dissolves in the ink which is in the ink chamber, the gas may turn into bubbles in the recording head or the tube when the ink is supplied to the inkjet recording apparatus, and the bubbles may clog the nozzles. When such bubbles clog the nozzles, ink may not be properly ejected from the nozzles. To prevent gas from dissolving in the ink, the ink may be deaerated, or the pressure in the ink chamber may be reduced, or both.

In the known ink cartridges, the ink chamber is brought into air communication with the atmosphere before or when the ink cartridge is mounted to the mounting portion. Nevertheless, when the ink cartridge is mounted to the mounting portion, the ink chamber may be brought into fluid communication with the recording head or the tube via the ink supply portion before the ink chamber is brought into air communication with the atmosphere. When this occurs, air or ink in the recording head or the tube may flow back into the ink chamber if the pressure in the ink chamber is reduced. Backflow of air or ink may cause the ink meniscus in the nozzles to be altered.

Another known ink cartridge, such as the ink cartridge described in Japanese Patent Publication Number JP-A-2003-300330, may prevent the ink meniscus from being altered. This known ink cartridge includes an ink chamber, an ink supply portion which includes an ink supply valve therein, an atmosphere communication opening through which the ink chamber is brought into air communication with the atmosphere, and a film which seals the atmosphere communication opening. Another known inkjet image recording apparatus, such as the inkjet recording apparatus also described in Japanese Patent Publication Number JP-A-2003-300330, includes a mounting portion having a protrusion and a pipe. The mounting portion is configured to receive the above-described another known ink cartridge, and each of the protrusion and the pipe extends from the bottom of the mounting portion in a direction parallel to a direction in which the ink cartridge is inserted into the mounting portion. When the ink cartridge is mounted to the mounting portion, the protrusion perforates the film, such that the ink chamber is brought into air communication with the atmosphere via the atmosphere communication opening, and the pipe applies a force to the ink supply valve, such that ink is supplied from the ink chamber to the inkjet recording apparatus via the ink supply portion. Because the protrusion extends further from the bottom of the mounting portion than the pipe, the protrusion perforates the film before the pipe applies the force to the ink supply valve. Therefore, the ink chamber is brought into air communication with the atmosphere before the ink chamber is brought into fluid communication with the inkjet recording apparatus via the ink supply portion.

Similarly, yet another ink cartridge, such as the ink cartridge described in Japanese Patent Publication Number JP-A-2005-238576, also includes an ink chamber, an ink supply portion, and an atmosphere communication opening, and yet another known inkjet image recording apparatus, such as the inkjet image recording apparatus also described in Japanese Patent Publication Number JP-A-2005-238576, includes an accommodating mounting portion having a first pipe and a second pipe. The ink supply portion includes an ink supply valve therein, and the atmosphere communication opening includes an atmosphere communication valve. The mounting portion is configured to receive the yet another known ink cartridge, and each of the first pipe and the second pipe extends from the bottom of the mounting portion in a direction parallel to a direction in which the ink cartridge is inserted into the mounting portion. When the ink cartridge is mounted to the mounting portion, the first pipe applies a force to the atmosphere communication valve, such that the ink chamber is brought into air communication with the atmosphere via the atmosphere communication opening, and the second pipe applies a force to the ink supply valve, such that ink is dispensed from the ink chamber to the inkjet recording apparatus via the ink supply portion. Because the first pipe extends further from the bottom of the mounting portion than the second pipe, the first pipe applies the force to the atmosphere communication valve before the second pipe applies the force to the ink supply valve. Therefore, the ink chamber is brought into air communication with the atmosphere before the ink chamber is brought into fluid communication with the inkjet recording apparatus via the ink supply portion.

Still another known inkjet image recording apparatus is configured to determine the amount of ink remaining in an ink cartridge based on the number of ink droplets which previously were ejected from the nozzles or the number of times the recording head previously was cleaned. Specifically, the inkjet image recording apparatus counts the number of ink droplets ejected from the nozzles or the number of times the recording head is cleaned. When the amount of ink remaining in the ink cartridge decreases to a predetermined amount of ink, the inkjet recording apparatus indicates that a user should replace the current ink cartridge with a new ink cartridge. For example, the inkjet image recording apparatus may include a lamp which alternates between an illuminated state and a non-illuminated state when the amount of ink remaining in the ink cartridge is less than or equal to the predetermined amount of ink. When the ink cartridge is removed from the mounting portion and the amount of ink in the ink cartridge is greater than the predetermined amount of ink, and the previously removed ink cartridge again is mounted to the mounting portion, the inkjet recording apparatus is reset to a state corresponding to when the amount of ink in the ink cartridge is at a maximum value. When this occurs, the amount of ink in the ink cartridge does not correspond to the amount of ink which the inkjet recording apparatus determined is in the ink cartridge. Consequently, the inkjet recording apparatus may fail to timely indicate that the amount of ink in the ink cartridge is less than or equal to the predetermined amount.

To prevent the inkjet recording apparatus from failing to timely indicate that the amount of ink in the ink cartridge is less than or equal to the predetermined amount, still yet another ink cartridge, such as the ink cartridge described in Japanese Patent Publication Number JP-A-2000-135796, includes a predetermined portion which still yet another known inkjet image recording apparatus, such as the inkjet recording apparatus also described in Japanese Patent Publication Number JP-A-2000-135796, is configured to detect. Specifically, the inkjet image recording apparatus is configured to perforate or bend the predetermined portion of the ink cartridge when the ink cartridge is mounted to the mounting portion. When the inkjet recording apparatus detects the predetermined portion of the ink cartridge, the inkjet recording apparatus determines that the mounted ink cartridge is an ink cartridge which has not previously been mounted to an inkjet recording apparatus. After the inkjet recording apparatus perforates or bends the predetermined portion of the ink cartridge, the image recording apparatus cannot detect the predetermined portion of the ink cartridge.

Nevertheless, if the ink cartridge includes separate portions for allowing the ink chamber to be in communication with the atmosphere and for indicating that the ink cartridge has not previously been mounted to an inkjet recording apparatus, the ink cartridge may be more complex and the amount of ink which the ink cartridge may store therein may be reduced.

SUMMARY OF THE INVENTION

Therefore, a need has arisen for ink cartridges, ink supply systems, and an image recording apparatus which overcome these and other shortcomings of the related art. A technical advantage of the present invention is that the same portion of the ink cartridge may be configured to both allow the ink chamber to be in air communication with the atmosphere and to indicate that the ink cartridge has not previously been mounted to an inkjet recording apparatus. Therefore, the manufacturing process may be simplified, the amount of ink which may be stored in the ink cartridge may be increased, and the cost of manufacturing the ink cartridge may be reduced.

According to an embodiment of the present invention, an ink cartridge comprises a case defining an ink chamber therein, in which the ink chamber is configured to store ink therein, and the case comprises a particular wall having an opening formed therethough. The ink cartridge also comprises an ink supply portion configured to dispense ink from an interior of the ink chamber to an exterior of the ink chamber, and a sealing portion positioned at the particular wall. At least a predetermined portion of the sealing portion is configured to selectively cover at least a first portion of the opening. Moreover, the ink cartridge comprises a protrusion positioned at the particular wall, in which the protrusion is configured to selectively cover a second portion of the opening, and a predetermined portion of the protrusion is configured to be selectively connected to the predetermined portion of the sealing portion. When a predetermined amount of force is applied to the protrusion in a predetermined direction the protrusion is configured to move from a first position in which the predetermined portion of the protrusion is connected to the predetermined portion of the sealing portion to a second position in which the predetermined portion of the protrusion is separated from at least a portion of the predetermined portion of the sealing portion to uncover at least one portion of the second portion of the opening, such that the interior of the ink chamber is in air communication with the exterior of the ink chamber via the at least one portion of the second portion of the opening.

According to another embodiment of the present invention, an ink cartridge comprises a case defining an ink chamber and an air chamber therein, in which the ink chamber is configured to store ink therein. The case comprises a first wall, and a second wall connected to the first wall, in which the second wall is substantially perpendicular to the first wall, a predetermined portion of the second wall defines the air chamber therein, and the predetermined portion of the second wall has an opening formed therethough. The ink cartridge also comprises an ink supply portion positioned at the first wall, in which the ink supply portion is configured to dispense ink from an interior of the ink chamber to an exterior of the ink chamber, and a sealing portion positioned at the predetermined portion of the second wall, in which at least a predetermined portion of the sealing portion is configured to selectively cover at least a first portion of the opening. Moreover, the ink cartridge comprises a protrusion positioned at the predetermined portion of the second wall, in which the protrusion is configured to selectively cover a second portion of the opening, and a predetermined portion of the protrusion is configured to be selectively connected to the predetermined portion of the sealing portion. When a predetermined amount of force is applied to the protrusion in a predetermined direction the protrusion is configured to move from a first position in which the protrusion extends away from and is positioned outside the air chamber to a second position in which the predetermined portion of the protrusion is positioned within the air chamber and is separated from at least a portion of the predetermined portion of the sealing portion to uncover at least one portion of the second portion of the opening, such that the interior of the ink chamber is in air communication with the exterior of the ink chamber via the at least one portion of the second portion of the opening and the air chamber.

According to another embodiment of the present invention, an ink supply system comprises an ink cartridge comprising a case defining an ink chamber therein, in which the ink chamber is configured to store ink therein, and the case comprises a particular wall having an opening formed therethough. The ink cartridge also comprises an ink supply portion configured to dispense ink from an interior of the ink chamber to an exterior of the ink chamber, and a sealing portion positioned at the particular wall. At least a predetermined portion of the sealing portion is configured to selectively cover at least a first portion of the opening. Moreover, the ink cartridge comprises a protrusion positioned at the particular wall, in which the protrusion is configured to selectively cover a second portion of the opening, and a predetermined portion of the protrusion is configured to be selectively connected to the predetermined portion of the sealing portion. The ink supply system also comprises a cartridge accommodating portion. The cartridge accommodating portion comprises an ink supply pipe, in which the ink supply portion is configured to receive the ink supply pipe, a sensor, and a contact portion. When the ink cartridge is inserted into the cartridge accommodating portion the sensor is configured to determine whether the protrusion is in a first position in which the predetermined portion of the protrusion is connected to the predetermined portion of the sealing portion. Moreover, when the sensor determines that the protrusion is in the first position the contact portion is configured to apply a predetermined amount of force to the protrusion to move the protrusion from the first position to a second position in which the predetermined portion of the protrusion is separated from at least a portion of the predetermined portion of the sealing portion to uncover at least one portion of the second portion of the opening, such that the interior of the ink chamber is in air communication with the exterior of the ink chamber via the at least one portion of the second portion of the opening.

Other objects, features, and advantages of embodiments of the present invention will be apparent to persons of ordinary skill in the art from the following description of preferred embodiments with reference to the accompanying drawings.

BRIEF DESCRIPTION OF THE DRAWINGS

For a more complete understanding of the present invention, the needs satisfied thereby, and the objects, features, and advantages thereof, reference now is made to the following description taken in connection with the accompanying drawings.

DETAILED DESCRIPTION OF EMBODIMENTS OF THE INVENTION

Embodiments of the present invention and their features and technical advantages may be understood by referring to FIGS. 1-9B, like numerals being used for like corresponding portions in the various drawings.

Figure 1:
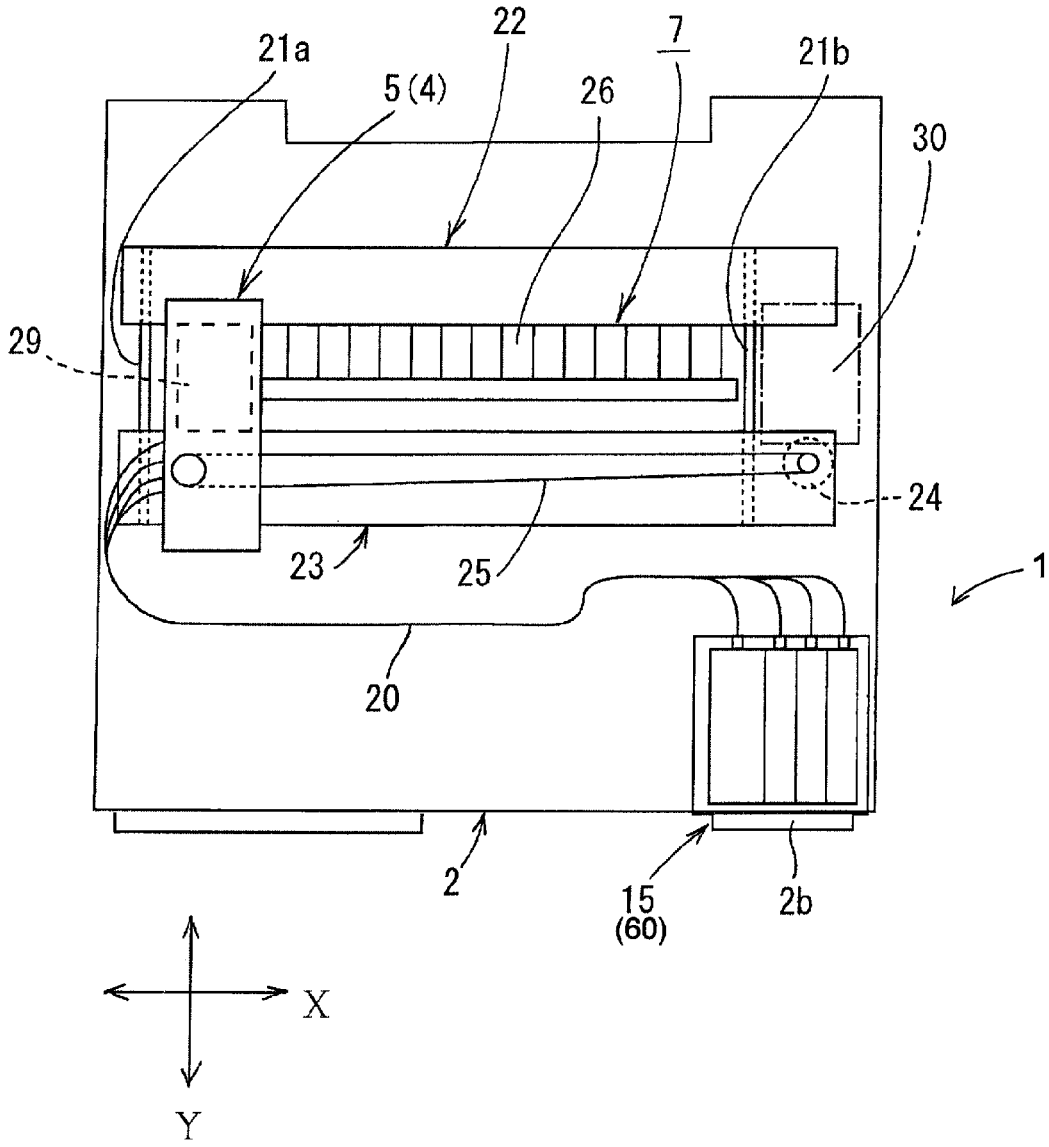
FIG. 1 is a plan view of an image recording apparatus, according to an embodiment of the invention.

Referring to FIG. 1, an image recording apparatus 1 according to an embodiment of the present invention is depicted. Image recording apparatus 1 may be a multi-functional device configured to operate as a printer, a copier, a scanner, or a facsimile, or any combination there, and may be coupled to a computer. Image recording apparatus 1 is configured to form images on a recording medium, e.g., a sheet of paper, based on data transmitted from the computer. Image recording apparatus 1 also may be coupled to an external apparatus, e.g., a digital camera, and may be configured to form images on a recording medium based on data transmitted from the external device.

Image recording apparatus 1 may comprise a case 2 and a recording unit 7 positioned in case 2. Case 2 may comprise a synthetic resin material. Image recording apparatus 1 also may comprise a paper cassette (not shown) positioned in case 2 below recording unit 7. Case 2 may have an insertion opening formed therethrough at the front of case 2. The paper cassette may be selectively inserted into and removed from case 2 horizontally through the insertion opening formed at the front of case 2. Moreover, image recording apparatus 1 may comprise an image reading unit (not shown) positioned above case 2. The image reading unit may be configured to read images from a document to copy the document or to transmit the document via facsimile. Image recording apparatus 1 further may comprise a control panel (not shown) positioned above case 2 in front of the image reading unit. The control panel may comprise a plurality of operation buttons and a liquid crystal display.

Image recording apparatus 1 also may comprise a cartridge accommodating device 15 positioned at the front of case 2 and at the right side of the paper cassette. Case 2 may comprise a cover 2*b*, and may have an opening formed therethrough at the front of case 2. The lower end of cover 2*b* is supported at the lower end of the opening, such that cover 2*b* is configured to pivot about the lower end of the opening. When cover 2*b* pivots forward, downward, and then lies down, cover 2*b* exposes cartridge accommodating device 15 through the opening. When cover 2*b* pivots upward, rearward, and then sits upright, cover 2*b* covers cartridge accommodating device 15.

The paper cassette is configured to accommodate a plurality of sheets of paper. Image recording apparatus 1 also may comprise a feed roller (not shown) and a separation plate (not shown). The feed roller and the separation plate are configured to separate one sheet from the other sheets of paper, and to feed the separated sheet of paper. The sheet of paper fed by the feed roller and the separation plate may be transferred to recording unit 7, which is positioned above the paper cassette, via a U-shaped paper path.

Figure 2:
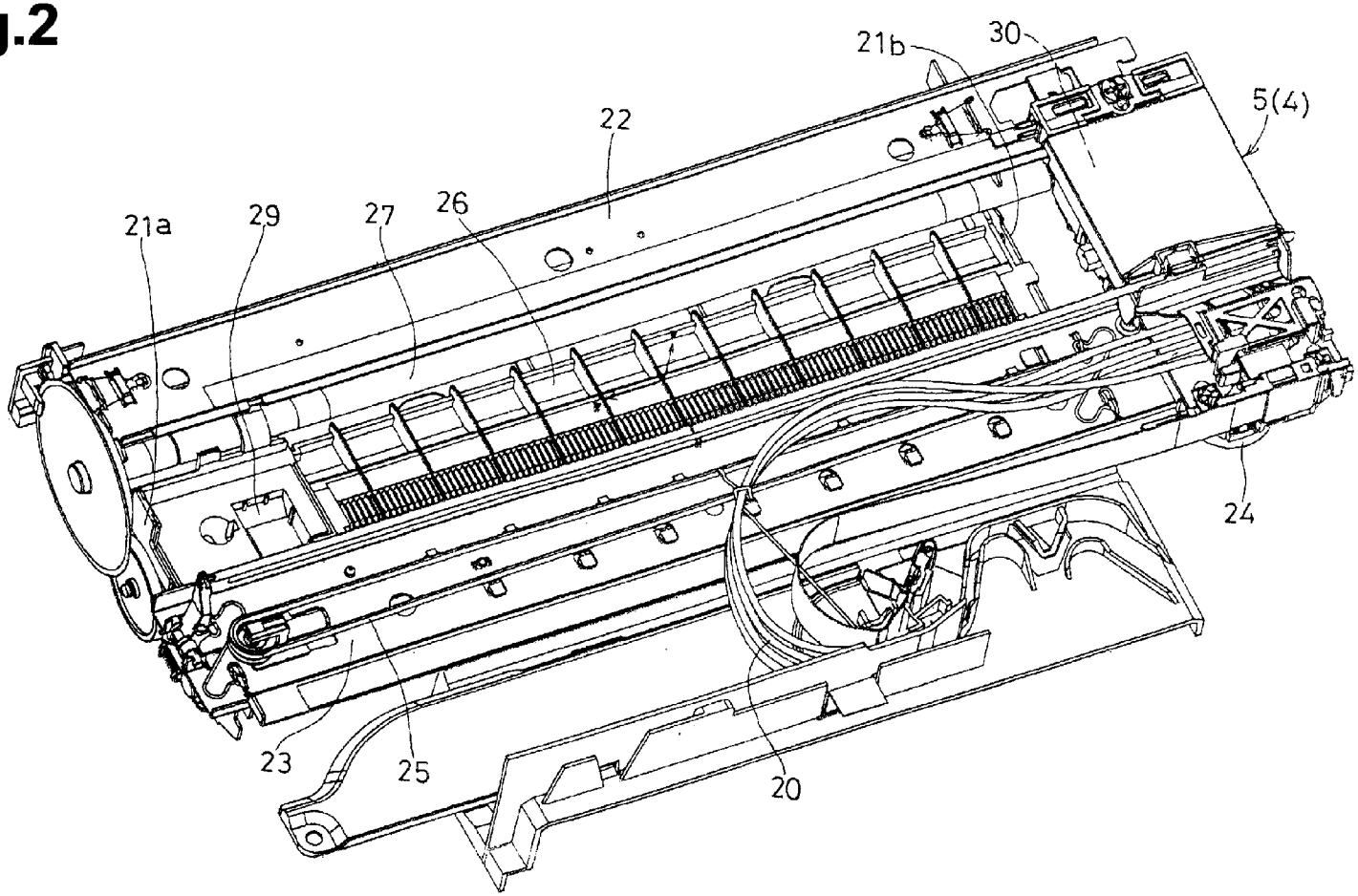
FIG. 2 is a perspective view of a recording unit of the image recording apparatus of FIG. 1.

Referring to FIGS. 1 and 2, recording unit 7 may comprise an inkjet head 4 mounted on a carriage 5, a main frame, a first guide member 22 and a second guide member 23 supported by the main frame and supporting carriage 5, a timing belt 25 connected to carriage 5, a motor 24 coupled to a timing belt 25 and configured to move timing belt 25, and a platen 26 positioned below inkjet head 4 and configured to support a sheet of paper. Motor 24 may be a DC motor or a stepping motor. The main frame comprises a left side wall 21*a* and a right side wall 21*b* opposite left side wall 21*a*. Each of first guide member 22 and second guide member 23 may have a thin plate shape extending in the X-direction, and may be supported by left side wall 21*a* and right side wall 21*b* at their ends. Carriage 5 may be supported by first guide member 22 and second guide member 23, and configured to slide along first guide member 22 and second guide member 22. Timing belt 25 may be a continuous endless belt extending above and parallel to second guide member 23, and coupled to a pulley and the shaft of motor 24. When motor 24 receives a driving force, timing belt 25 moves, and carriage 5 reciprocates accordingly. Recording unit 7 further may comprise a tape scale extending in the X-direction. The tape scale may be a component of an optical linear encoder provided in image recording apparatus 1, and may be configured to detect a position and a speed of carriage 5 in the X-direction.

Referring to FIG. 1, image recording apparatus 1 may comprise an ink receiving portion 29 positioned on the left side of platen 26, and a maintenance unit 30 positioned on the right side of platen 26. Carriage 5 may be configured to move to ink receiving portion 29 periodically during operation of inkjet head 4, such that inkjet head 4 faces ink receiving portion 29. Inkjet head 4 may be configured to perform a flushing operation, e.g., discharging ink to ink receiving portion 29 when inkjet head 4 faces ink receiving portion 29, which reduces the likelihood of nozzle clogging. Carriage 5 may be configured to remain at a position where inkjet head 4 faces maintenance unit 30 when inkjet head 4 is waiting for the next operation, e.g., when not performing printing. Maintenance unit 30 may be configured to draw ink from inkjet head 4 through the nozzles in order to eliminate air trapped in inkjet head 4, or to eliminate thickened ink from inkjet head 4. Maintenance unit 30 may comprise a wiper (not shown), and the wiper may be configured to wipe the nozzle surface of inkjet head 4 when carriage 5 moves from the position where inkjet head 4 faces maintenance unit 30 to a position where inkjet head 4 faces platen 26.

Figure 3:
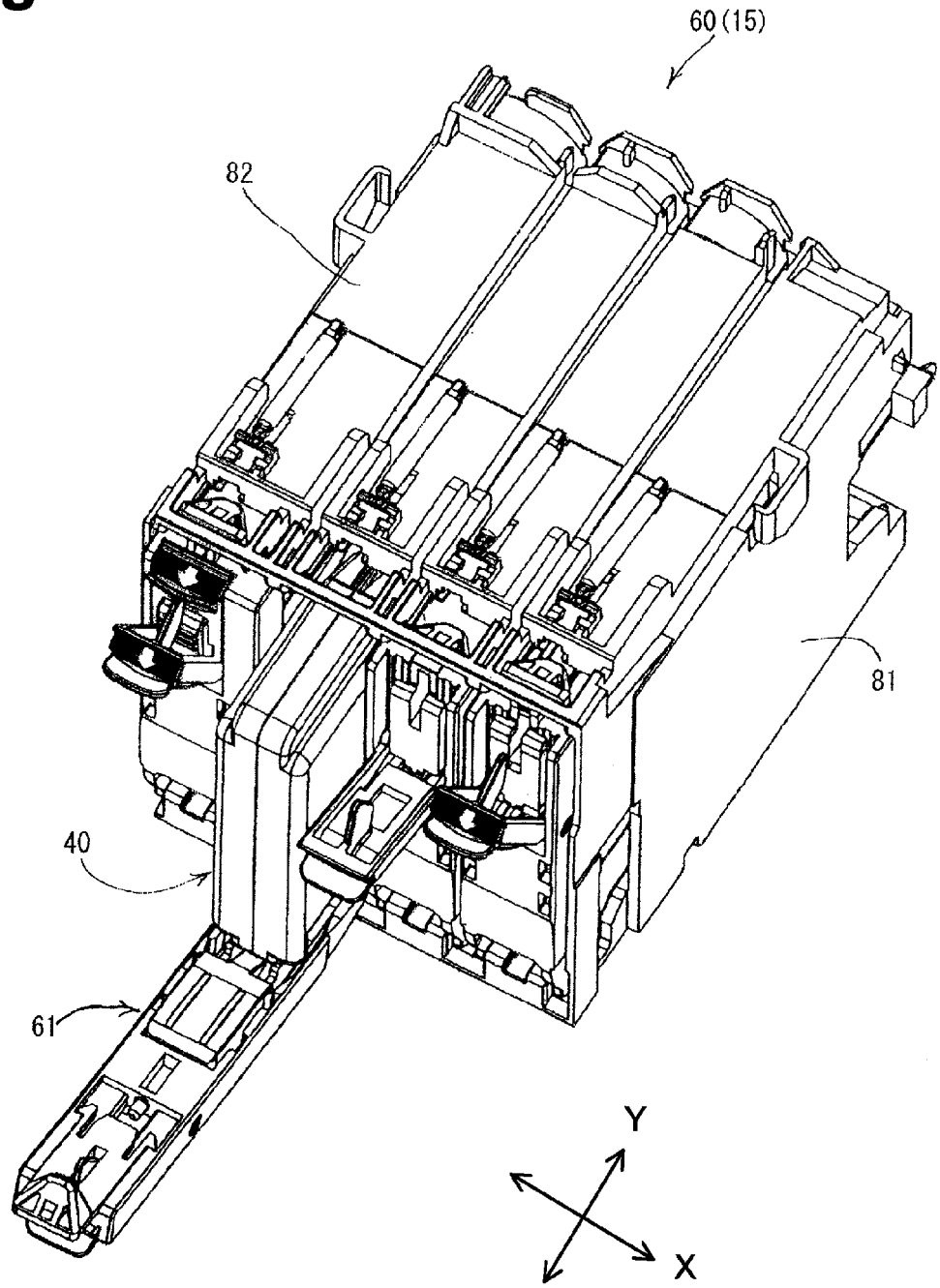
FIG. 3 is a perspective view of a cartridge accommodating device and an ink cartridge, according to an embodiment of the present invention.

Referring to FIG. 3, an ink supply system according to an embodiment of the present invention may comprise cartridge accommodating device 15, and at least one ink cartridge 40. In this embodiment, cartridge accommodating device 15 may comprise a cartridge accommodating portion, e.g., accommodating case 60. Accommodating case 60 may be configured to accommodate a plurality of e.g., four, ink cartridges 40, and each ink cartridge 40 may store ink of a different color, such as a black ink cartridge storing black ink, a cyan ink cartridge storing cyan ink, a magenta ink cartridge storing magenta ink, and a yellow ink cartridge storing yellow ink. Ink cartridges 40 may be positioned in a row along the X-direction. Accommodating case 60 has an opening formed therethrough at the front of accommodating case 60, and cartridge accommodating device 15 may comprise a plurality of, e.g., four, doors 61. The lower end of each door 61 may be supported at the lower end of the opening of accommodating case 60, such that door 61 pivots about the lower end to selectively cover at least a portion of the opening of accommodating case 60. When door 61 is opened, i.e., pivots forward, downward, and then lies down, such that at least portion of the opening of accommodating case 60 is uncovered, ink cartridge 40 may be selectively inserted into accommodating case 60 in a insertion direction and removed from accommodating case 60 in a direction opposite the insertion direction. When ink cartridge 40 is positioned in accommodating case 60, and door 61 is closed, i.e., pivots upward, rearward, and then sits upright, such that door 61 covers at least a portion of the opening of accommodating case 60, door 61 retains ink cartridge 40 within accommodating case 60.

Figure 4:
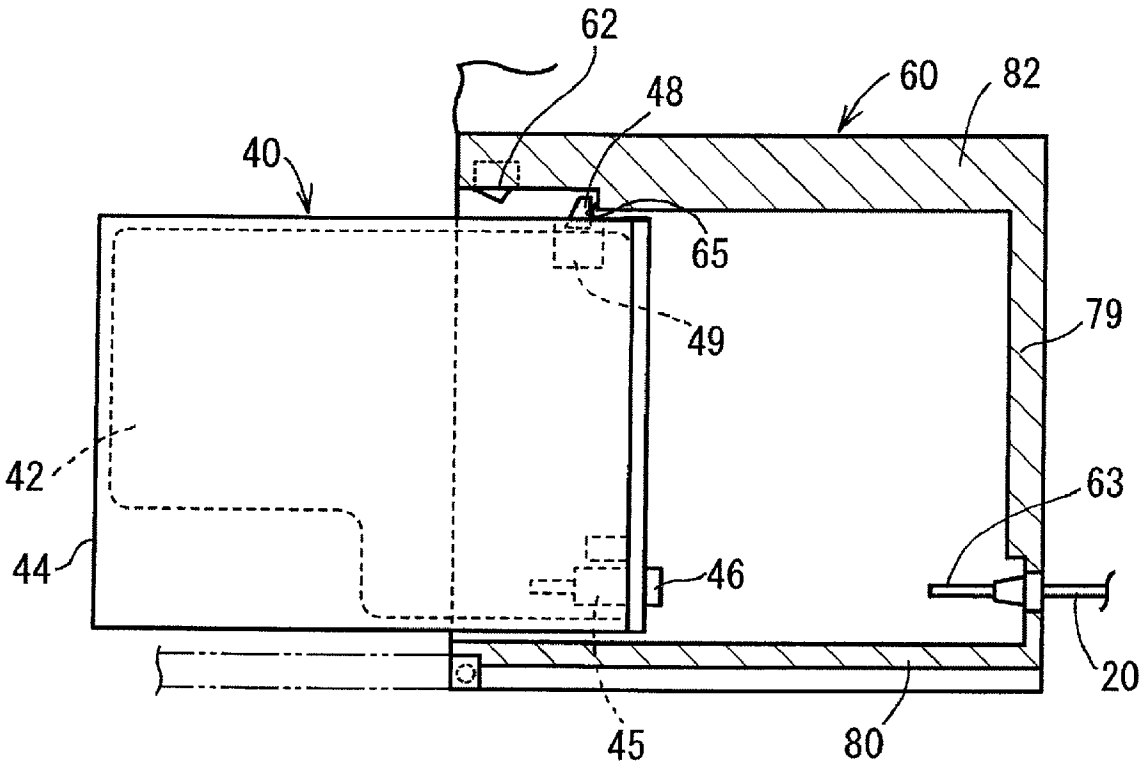
FIG. 4 is a side view of the ink cartridge and a side sectional view of the cartridge accommodating device of FIG. 3, in which the ink cartridge is being inserted into the cartridge accommodating device.
Figure 5:
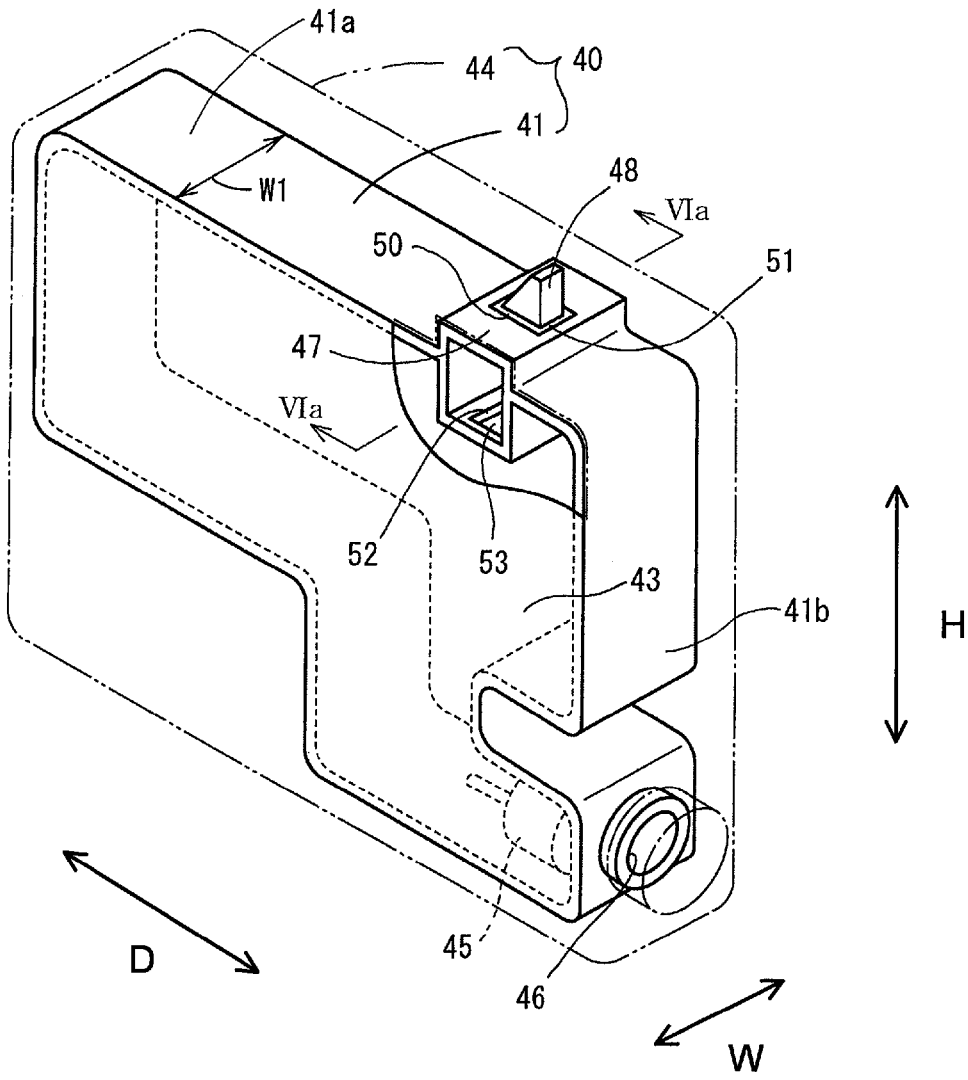
FIG. 5 is a perspective view of the ink cartridge of FIG. 4.
Figure 6A:
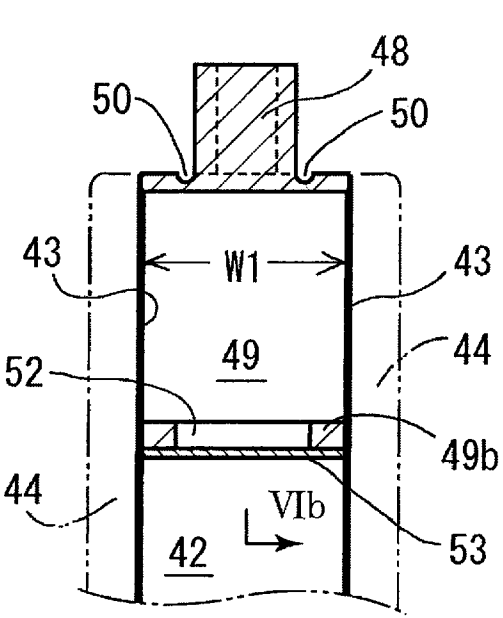
FIG. 6A is a partially, enlarged cutaway sectional view of the ink cartridge of FIG. 5 taken along the line VIa-VIa of FIG. 5.
Figure 6B:
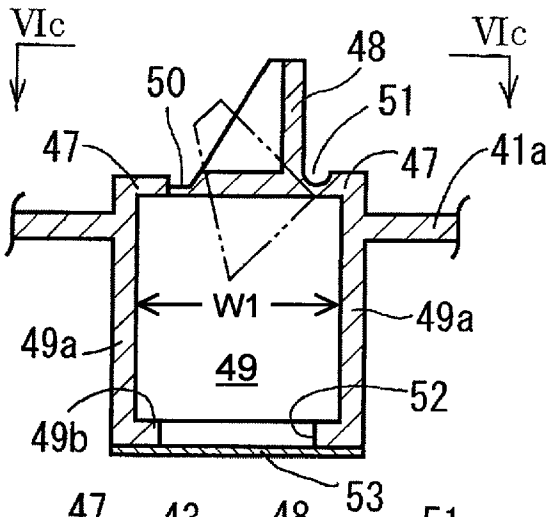
FIG. 6B is a sectional view of the ink cartridge of FIG. 6A taken along the line VIb-VIb of FIG. 6A.
Figure 6C:
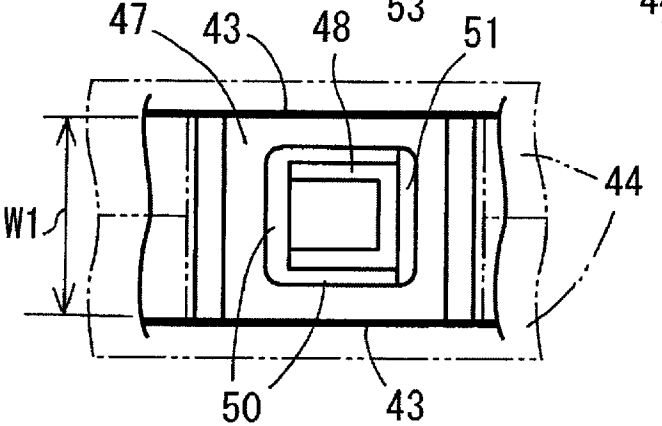
FIG. 6C is a plan view of the ink cartridge of FIG. 6B viewed in the direction of the arrows VIc-VIc.
Figure 7C:
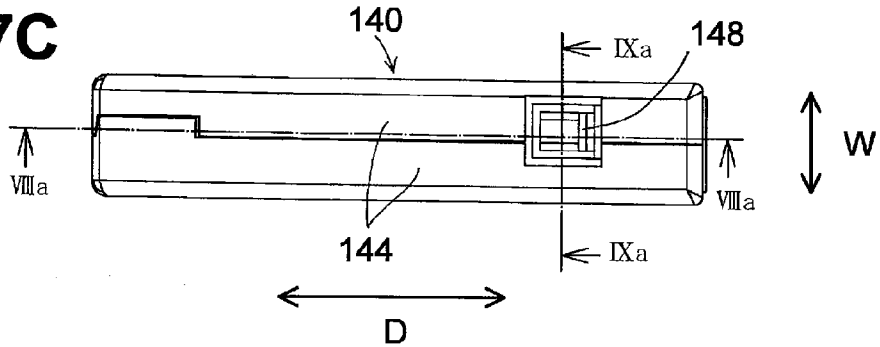
FIG. 7C is a plan view of the ink cartridge of FIG. 7A.
Figure 7B:
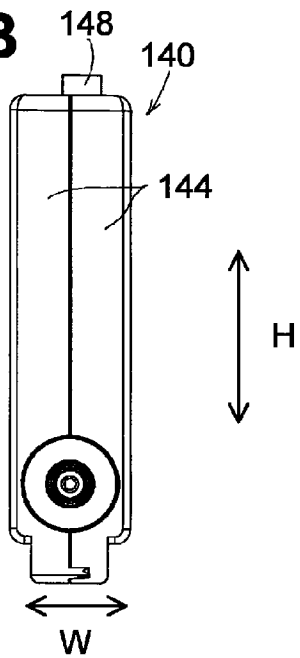
FIG. 7B is a front view of the ink cartridge of FIG. 7A.
Figure 7A:
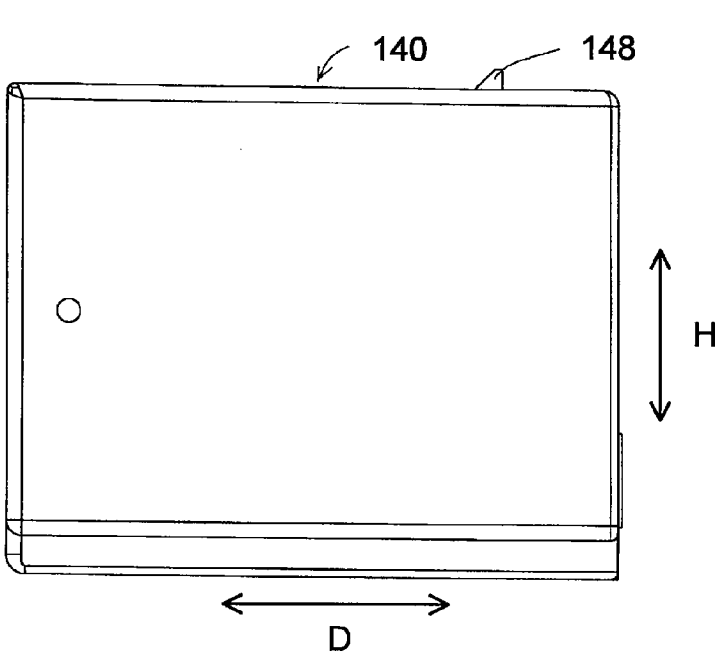
FIG. 7A is a side view of an ink cartridge, according to another embodiment of the invention.
Figure 8B:
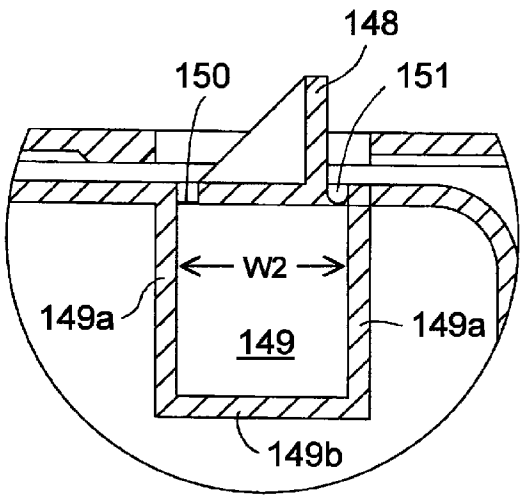
FIG. 8B is a partially enlarged, sectional view of the ink cartridge of FIG. 8A.
Figure 8A:
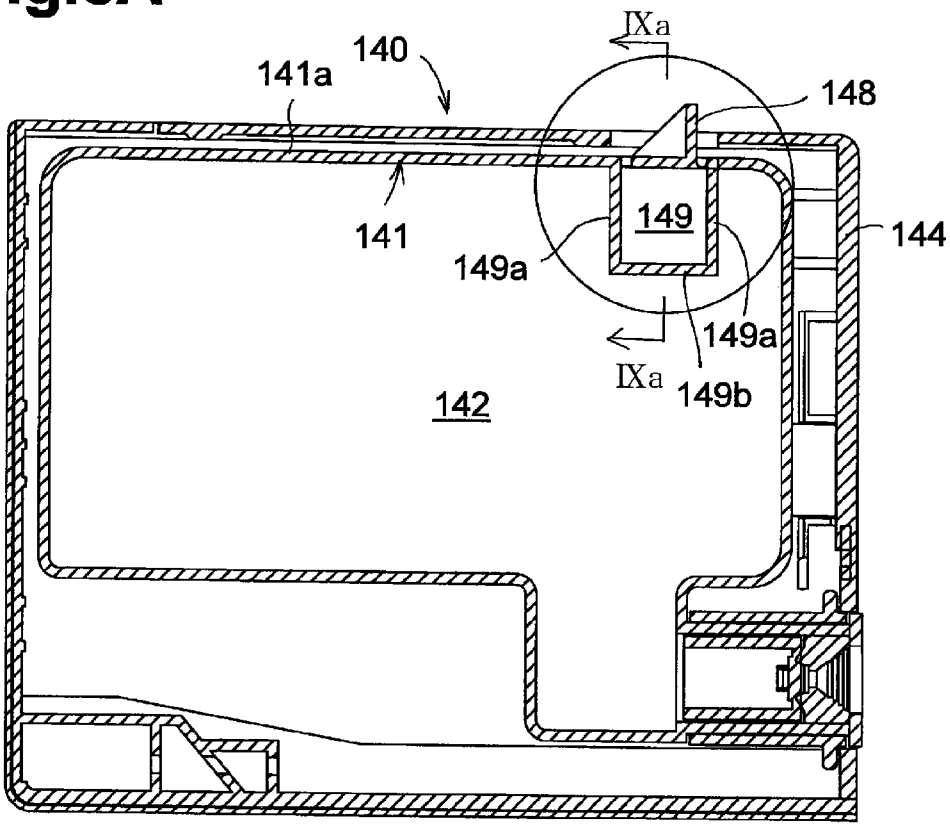
FIG. 8A is a sectional view of the ink cartridge of FIG. 7C taken along line VIIIa-VIIIa of FIG. 7C.
Figure 9A:
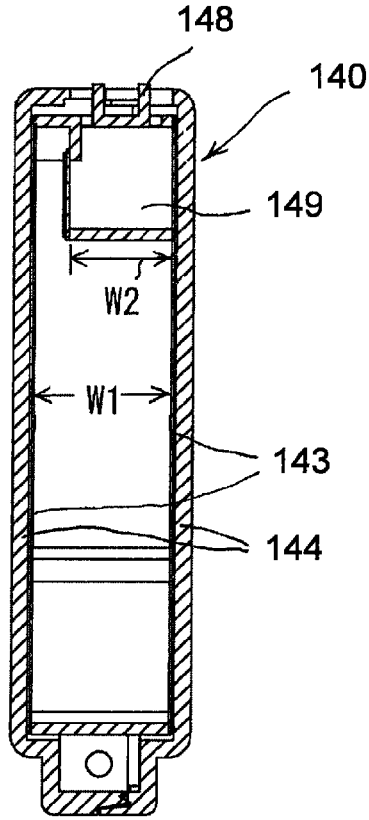
FIG. 9A is a sectional view of the ink cartridge of FIG. 7C taken along line IXa-IXa of FIG. 7C.
Figure 9B:
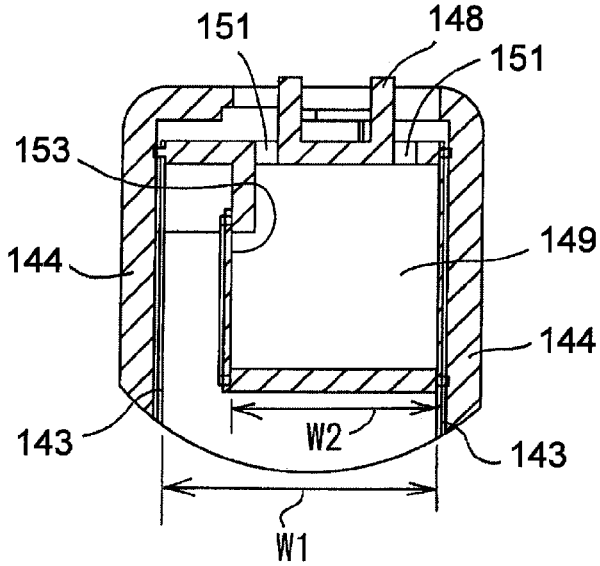
FIG. 9B is a partially, enlarged sectional view of the ink cartridge of FIG. 9A.

Referring to FIGS. 4 and 5, ink cartridge 40 may have a substantially rectangular, parallelepiped shape having a width in a width direction indicated by an arrow W in FIG. 5, a depth in a depth direction indicated by an arrow D in FIG. 5, and a height in a height direction indicated by an arrow H in FIG. 5. Each of the height and the depth of ink cartridge 40 may be greater than the width of ink cartridge 40. In this embodiment, four ink cartridges 40, each storing a different one of cyan ink, magenta ink, yellow ink and black ink, may be used, as described above. The width of the black ink cartridge may be greater than the width of each of the cyan ink cartridge, magenta ink cartridge, and yellow ink cartridge because black ink tends to be consumed more frequently than cyan ink, magenta ink, and yellow ink. Ink cartridges 40 storing ink other than black ink may have the same shape.

Each ink cartridge 40 may comprise a frame 41, a pair of films 43, and a pair of outer cases 44. Frame 41 may comprise a peripheral wall having a perimeter which extends in height direction H and depth direction D, and forms openings on both widthwise ends of frame 41. Each of the pair of films 43 may be connected, e.g., adhered, to the corresponding one of the widthwise ends of frame 41, for example, via a thermal adhesion method or using an adhesive agent, to cover the corresponding one of the openings of frame 41. Frame 41 and the pair of films 43 define an ink chamber 42 therein. Outer cases 44 enclose frame 41 and the pair of films 43. Outer cases 44 may be connected, e.g., adhered, to each other, for example, via a thermal adhesion method. Outer cases 44 may be connected to each other in a plane parallel to height direction H and depth direction D of ink cartridge 40, and may pass through the center of ink cartridge 40 in width direction W.

Accommodating case 60 may comprise a rear wall 79 positioned opposite the opening of accommodating case 60, and ink cartridge 40 may be inserted into accommodating case 60 in the insertion direction from the opening of accommodating case 60 toward rear wall 79. When ink cartridge 40 is inserted into accommodating case 60, depth direction D of ink cartridge 40 is aligned with the insertion direction.

The peripheral wall of frame 41 may comprise a front wall 41*b*, and when ink cartridge 40 is inserted into accommodating case 60, frame 41 may be inserted into accommodating case 60 from front wall 41*b* side. Ink cartridge 40 may have an ink supply opening 46 formed through front wall 41*b*. When ink cartridge 40 is inserted into accommodating case 60, ink supply opening 46 may be positioned adjacent to a lower end of front wall 41*b*. Ink supply opening 46 may have a substantially circular cone shape. Ink cartridge 40 may comprise an ink supply valve 45 positioned in rear of ink supply opening 46 with respect to the insertion direction.

Referring to FIG. 4-7C, ink cartridge 40 may comprise a particular wall which extends substantially parallel to the insertion direction when ink cartridge 40 is inserted into accommodating case 60. The particular wall may have a particular opening formed therethrough. Ink cartridge 40 may comprise a protrusion 48 which extends away from the particular wall toward an outside of ink cartridge 40, and a sealing portion 47. For example, the peripheral wall of frame 41 may comprise an upper wall 41*a*. Upper wall 41*a* extends substantially parallel to the insertion direction and may be positioned at the top of frame 41 when ink cartridge 40 is inserted into accommodating case 60. Therefore, when ink cartridge 40 is inserted into accommodating case 60, at least a portion of upper wall 41*a* may be positioned above ink chamber 42. Upper wall 41*a* may have the particular opening formed therethrough, and an air chamber 49 may be recessed from the particular opening toward ink chamber 42, such that air chamber 49 of upper wall 41*a* may be a recessed portion. The particular opening may be positioned adjacent to the front end of upper wall 41*a* with respect to the insertion direction when ink cartridge 40 is inserted into accommodating case 60. Air chamber 49 may be configured to be in air communication with ink chamber 42. Sealing portion 47 may be connected to those portions of upper wall 41*a* which define the outer perimeter of the particular opening, and may be positioned at an end of air chamber 49. Sealing portion 47 also may be connected to protrusion 48. Protrusion 48 may extend toward the outside of ink cartridge 40 via outer cases 44 away from upper wall 41*a* in height direction H. Protrusion 48 may extend upwardly away from upper wall 41*a* when ink cartridge 40 is inserted into accommodating case 60.

The particular opening positioned at the end of air chamber 49 may be sealed by a combination of sealing portion 47 and protrusion 48, such that sealing portion 47 and protrusion 48 are configured to selectively prevent air communication between ink chamber 42 and the outside of ink cartridge 40 via air chamber 49 and the particular opening. Sealing portion 47 may comprise a first portion 50, e.g., a first weakened portion, connected to protrusion 48, and first weakened portion 50 generally may have a "U" shape, such that first weakened portion 50 comprises two first sub-portions extending in a direction parallel to the insertion direction, and a second sub-portion extending from an end of one of the first sub-portions to an end of the other of the first sub-portions in a direction perpendicular to the insertion direction at the rear of protrusion 48 with respect to the insertion direction. Sealing portion 47 further may comprise a second portion 51, e.g., a second weakened portion, connected to protrusion 48 at the front of protrusion 48 with respect to the insertion direction. The thickness of each of first weakened portion 50 and second weakened portion 51 may be less than the thickness of the remaining portion of sealing portion 47, i.e., those portions of sealing portion 47 which comprise neither first portion 50 not second portion 51, in height direction H. Moreover, the thickness of first weakened portion 50 may be less than the thickness of second weakened portion 51 in height direction H.

When ink cartridge 40 is inserted into accommodating case 60, a contact portion 65 positioned in accommodating case 60 applies a force to protrusion 48, e.g., contacts and pushes protrusion 48. Accordingly, protrusion 48 changes its position from a first position in which protrusion 48 extends in height direction H to a second position in which protrusion 48 is inclined rearward and downward toward air chamber 49 with respect to the insertion direction, e.g., at least a portion of protrusion 48 is positioned within air chamber 49. When protrusion 48 moves from the first position to the second position, first weakened portion 50 is perforated, e.g., torn, such that protrusion 48 becomes separated from at least a portion of first weakened portion 50 while remaining connected to second weakened portion 51. Consequently, ink chamber 42 is brought into air communication with the atmosphere via air chamber 49 and at least a portion of the particular opening, e.g., the portion of the particular opening which is exposed when protrusion 48 separates from at least a portion of first weakened portion 50. Moreover, protrusion 48 may not separate from ink cartridge 40, and a user may not have to dispose of protrusion 48. Moreover, even if protrusion 48 should separate from ink cartridge 40 in its entirety, because at least a portion of protrusion 48 is in air chamber 49 when protrusion 48 is in the second position, separated protrusion 48 may be retained in air chamber 49 and may not be left in accommodating case 60. Therefore, when new ink cartridge 40 is inserted into accommodating case 60, separated protrusion 48 may not prevent the insertion of new ink cartridge 40 into accommodating case 60.

When first weakened portion 50 is torn, ink in ink chamber 42 is brought into air communication with the atmosphere. A semi-permeable film, i.e., a film comprising a synthetic resin material which allows air to pass therethrough but prevents liquid from passing therethrough, may be positioned between air chamber 49 and ink chamber 42, and ink in ink chamber 42 may be brought into air communication with the atmosphere via the semi-permeable film. The semi-permeable film may prevent ink from leaking to the outside of ink cartridge 40.

Frame 41 and air chamber 49 each may have a width W1 in width direction W. Upper wall 41*a* of frame 41 may comprise a horizontally extending portion extending in a plane parallel to width direction W and depth direction D, and a pair of vertically extending portions 49*a* which are positioned adjacent to the front end of upper wall 41*a* with respect to the insertion direction. Each vertically extending portion 49*a* extends from the horizontally extending portion of upper wall 41*a* in height direction H. Vertically extending portions 49*a* may be spaced apart by distance W1 in depth direction D. The pair of vertically extending portions 49*a* and the pair of films 43 may define air chamber 49 therein. The particular opening positioned at the end of air chamber 49 may be covered with sealing portion 47 comprising first weakened portion 50 and second weakened portion 51 and with protrusion 48 to selectively prevent air communication with the atmosphere through the particular opening. An end of each vertically extending portion 49*a* closer to ink chamber 42 may be connected to a connecting portion 49*b*. Connecting portion 49*b* may extend in a plane parallel to width direction W and depth direction D, and may have a width W1 in width direction W. An opposite end of each vertically extending portion 49*a* may extend i.e., be raised, from a surface of the horizontally extending portion of upper wall 41*a* toward the outside of ink cartridge 40 by a distance corresponding to a thickness of outer cases 44 in height direction H. Connecting portion 49*b* may have an opening 52 formed therethrough. A semi-permeable film 53 may be connected, e.g., adhered via an adhesive agent, to connecting portion 49*b*, such that semi-permeable film 53 covers opening 52.

A method for manufacturing ink cartridge 40 is depicted. Frame 41 may be integrally formed from a synthetic resin material by injection molding. Thereafter, semi-permeable film 53 may be connected, e.g., adhered via an adhesive agent, to connecting portion 49*b*, such that semi-permeable film 53 covers opening 52. Then, the pair of films 43 are connected, e.g., adhered, such as by using a thermal adhesion method or an adhesive agent, to widthwise ends of the peripheral wall, sealing portion 47, the pair of vertically extending portions 49*a*, and connecting portion 49*b*, such that the openings on both widthwise ends of frame 41 are sealed with the pair of films 43, respectively.

Referring to FIGS. 3 and 4, accommodating case 60 may comprise a resin material formed into a substantially rectangular parallelepiped shape. Accommodating case 60 may comprise a bottom plate 80, a pair of side plates 81 extending perpendicular to bottom plate 80 from each end of bottom plate 80 in the X direction, a top plate 82 positioned opposite bottom plate 80 and connected to each of side plates 81, and an rear wall 79 connected to bottom plate 80, side plates 81, and top plate 82. Accommodating case 60 may comprise a cartridge sensor 62 positioned at a lower surface of top plate 82 adjacent to the opening of accommodating case 60. In this embodiment, cartridge sensor 62 may be a limit switch comprising a movable member. Cartridge sensor 62 detects protrusion 48 of ink cartridge 40 when protrusion 48 contacts and raises the movable member of the limit switch. If protrusion 48 is in the first position, protrusion 48 contacts and raises the movable member of the limit switch when ink cartridge 40 is inserted into accommodating case 60. If protrusion 48 is in the second position, protrusion 48 does not contact and raise the movable member of the limit switch when ink cartridge 40 is inserted into accommodating case 60. In another embodiment, cartridge sensor 62 may comprise an optical sensor comprising a light-emitting device and a light-receiving device. The optical sensor may detect protrusion 48 when protrusion 48 enters an optical path between the light-emitting device and the light-receiving device and interrupts the light of the optical sensor. If protrusion 48 is in the first position, protrusion 48 enters the optical path of the optical sensor and interrupts the light of the optical sensor when ink cartridge 40 is inserted into accommodating case 60. If protrusion 48 is in the second position, protrusion 48 does not enter the optical path of the optical sensor and does not interrupt the light of the optical sensor when ink cartridge 40 is inserted into accommodating case 60. The lower surface of top plate 82 may comprise a contact portion 65 positioned adjacent to the opening of accommodating case 60 between cartridge sensor 62 and rear wall 79. For example, the lower surface of top plate 82 may comprise two levels, and contact portion 65 may comprise a wall surface connecting the two levels, which wall surface extends in a direction substantially perpendicular to the insertion direction, and which wall surface faces the opening of accommodating case 60. Accommodating case 60 further may comprise an ink supply pipe 63 extending from rear wall 79 toward the opening of accommodating case 60 in a direction opposite the insertion direction. Ink supply pipe 63 may be configured to enter ink supply opening 46 when ink cartridge 40 is inserted into accommodating case 60, and to apply a force to and open ink supply valve 45.

Accommodating case 60 further may comprise a plurality of partition walls (not shown) defining cartridge chambers inside accommodating case 60 to accommodate and retain ink cartridges 40 in the respective cartridge chambers. Each partition wall extends from the opening of accommodating case 60 toward rear wall 79. In this embodiment, the pair of side plates 81 and three partition walls define four cartridge chambers. Cartridge sensor 62, contact portion 65, and ink supply pipe 63 may be provided in each of the cartridge chambers.

Referring to FIG. 3, door 61 is positioned at the opening of accommodating case 60 in correspondence with each cartridge chamber. Each ink cartridge 40 may be selectively inserted into and removed from the corresponding cartridge chamber through the opening.

Contact portion 65 may be positioned adjacent to the opening of accommodating case 60, such that when ink cartridge 40 is inserted into the cartridge chamber, contact portion 65 applies a force to protrusion 48, e.g., contacts and pushes protrusion 48, perforating first weakened portion 50 to bring ink chamber 42 into air communication with the atmosphere before ink supply pipe 63 applies a force to and opens ink supply valve 45.

When ink cartridge 40 is inserted in the insertion direction into the cartridge chamber of accommodating case 60, cartridge sensor 62 first detects protrusion 48. Then, while ink cartridge 40 is being inserted toward rear wall 79, the front face of protrusion 48 contacts contact portion 65. As ink cartridge 40 is further inserted toward rear wall 79, a pressing force applied in the insertion direction to ink cartridge 40 is applied to protrusion 48 via contact portion 65 as a counteracting force. Accordingly, first weakened portion 50 is perforated, and protrusion 48 is pushed rearward and downward, such that air chamber 49 is brought into air communication with the atmosphere. At least a portion of protrusion 48 is positioned within air chamber 49, and protrusion 48 is connected to sealing portion 47 via second weakened portion 51, as shown by double dashed chain lines in FIG. 6B.

Protrusion 48 of a new ink cartridge 40 which never has been inserted into accommodating case 60 is in the first position in which protrusion 48 extends from an upper surface of ink cartridge 40 substantially perpendicular to the upper surface when ink cartridge 40 is inserted into accommodating case 60. When new ink cartridge 40 is inserted into accommodating case 60, cartridge sensor 62 detects protrusion 48 and thus, it is determined that a new ink cartridge 40 is inserted into accommodating case 60. Immediately thereafter, contact portion 65 applies a force to protrusion 48, e.g., contacts and pushes protrusion 48, and protrusion 48 moves from the first position to the second position. Once the protrusion 48 is in the second position, protrusion 48 no longer may be detectable by cartridge sensor 62 when ink cartridge 40 is inserted into accommodating case 60. For example, when it is determined that a new ink cartridge 40 is inserted into accommodating case 60, image recording apparatus 1 is configured to reset the counted value representing the number of ink droplets ejected from inkjet head 4 or an amount of ink remaining in ink cartridge 40, and restart counting the number of ink droplets ejected from inkjet head 4 or an amount of ink remaining in ink cartridge 40. In contrast, if ink cartridge 40 is removed from accommodating case 60 after being mounted therein, and the removed ink cartridge 40 again is inserted into accommodating case 60, image recording apparatus 1 does not reset the counted value because protrusion 48 of ink cartridge 40 is in the second position and therefore, is not detected by cartridge sensor 62. Therefore, image recording apparatus 1 may correctly determine the amount of ink remaining in ink cartridge 40. Moreover, air is introduced into ink chamber 42 of ink cartridge 40, such that the pressure in ink chamber 42 becomes substantially equal to the atmospheric pressure before ink supply pipe 63 opens ink supply valve 45. Therefore, ink does not flow back into ink chamber 42 via ink supply pipe 63, and the menisci of ink in the nozzles of inkjet head 4 are not damaged.

When ink cartridge 40 is inserted into accommodating case 60, protrusion 48, air chamber 49, and semi-permeable film 53 may be positioned above ink supply opening 46. Therefore, when first weakened portion 50 is perforated, and ink chamber 42 is brought into air communication with the atmosphere, air accumulates in an upper portion of ink chamber 42 separate from ink supply valve 45.

Referring to FIGS. 7A-9B, an ink cartridge 140 according to another embodiment of the present invention is depicted. Ink cartridge 140 may comprise a frame 141 comprising a peripheral wall. The peripheral wall may comprise an upper wall 141*a*. Upper wall 141*a* extends substantially parallel to the insertion direction and is positioned at the top of frame 141 when ink cartridge 140 is inserted into accommodating case 60. Upper wall 141*a* may have a particular opening formed therethrough, and an air chamber 149 may be recessed toward ink chamber 142 from the particular opening. The particular opening may be positioned adjacent to the front end of upper wall 141*a* with respect to the insertion direction when ink cartridge 140 is inserted into accommodating case 60. Air chamber 149 may be configured to be air communication with an ink chamber 142. Air chamber 149 may have a width W2, which is less than width W1 of the peripheral wall of frame 41 in width direction W. Upper wall 141*a* of frame 141 may comprise a horizontally extending portion extending in a plane parallel to width direction W and depth direction D, and a pair of vertically extending portions 149*a* positioned adjacent to the front end of upper wall 141*a* with respect to the insertion direction. Each vertically extending portion 149*a* extends in height direction H from the horizontally extending portion of upper wall 141*a* toward ink chamber 142. The pair of vertically extending portions 149*a* may be spaced apart by distance W2 in depth direction D. An end of each vertically extending portion 149*a* closer to ink chamber 142 may be connected to a connecting portion 149*b*. Connecting portion 149*b* extends in a plane parallel to width direction W and depth direction D and has width W2 in width direction W. One widthwise end of each of vertically extending portions 149*a*, connecting portion 149*b*, and peripheral wall of frame 141 may be positioned in the same plane parallel to height direction H and depth direction D. An opposite, widthwise end of each of vertically extending portions 149*a* and connecting portion 149*b* may be positioned within the width of the peripheral wall of frame 141. A semi-permeable film 153 may be connected e.g., adhered via an adhesive agent, to the opposite widthwise ends of vertically extending portions 149*a* and of connecting portion 149*b*. One of a pair of films 143 may be connected, e.g., adhered using a thermal adhesion method or an adhesive agent, to the one widthwise end of each of vertically extending portions 149*a*, connecting portion 149*b*, and the peripheral wall of frame 141. The other one of films 143 may be connected to the opposite widthwise end of the peripheral wall of frame 141. The pair of vertically extending portions 149*a*, one of films 143, and connecting portion 149*b* may define air chamber 149 therein. Similar to ink cartridge 40, the particular opening positioned at the upper end of air chamber 149 may be sealed with a sealing portion 147 comprising a first weakened portion 150 and a second weakened portion 151, and with a protrusion 148, and outer cases 144 may enclose frame 141.

In this embodiment, connecting portion 149*b* may not have an opening formed therethrough. Therefore, frame 141 may be formed more readily than frame 41. Further, the pair of films 143 and semi-permeable film 153 are parallel to each other, such that semi-permeable film 153 readily may be connected to frame 141.

In yet another embodiment, an ink cartridge does not comprise a semi-permeable film. In this case, a protrusion and a first weakened portion may be positioned at the upper wall of the ink cartridge when the ink cartridge is inserted into an accommodating case, to prevent ink in an ink chamber from leaking to the outside of the ink cartridge via the perforated first weakened portion. If ink should leak out of the ink chamber, air chamber may hold the leaking ink.

In still another embodiment, an accommodating case has an opening formed therethrough at the top of the accommodating case and an ink supply pipe extends from a bottom end of the accommodating case toward the opening. An ink cartridge is configured to be inserted into the accommodating case in the vertical direction, e.g., in the direction of gravitational pull. An ink cartridge sensor and a contact portion are positioned at a vertically extending wall of the accommodating case.

In still yet another embodiment, an accommodating case is positioned on a carriage mounting an inkjet head.

While the invention has been described in connection with various exemplary structures and illustrative embodiments, it will be understood by those skilled in the art that other variations and modifications of the structures and embodiments described above may be made without departing from the scope of the invention. Other structures and embodiments will be apparent to those skilled in the art from a consideration of the specification or practice of the invention disclosed herein. It is intended that the specification and the described examples are illustrative with the true scope of the invention being defined by the following claims.

What is claimed is:

1. An ink cartridge comprising:

a case defining an ink chamber therein, wherein the ink chamber is configured to store ink therein, and the case comprises a particular wall having an opening formed therethough;

an ink supply portion configured to dispense ink from an interior of the ink chamber to an exterior of the ink chamber;

a sealing portion positioned at the particular wall, wherein at least a predetermined portion of the sealing portion is configured to selectively cover at least a first portion of the opening; and a protrusion positioned at the particular wall, wherein the protrusion is configured to selectively cover a second portion of the opening, and a predetermined portion of the protrusion is configured to be selectively connected to the predetermined portion of the sealing portion, wherein, when a predetermined amount of force is applied to the protrusion in a predetermined direction the protrusion is configured to move from a first position in which the predetermined portion of the protrusion is connected to the predetermined portion of the sealing portion to a second position in which the predetermined portion of the protrusion is separated from at least a portion of the predetermined portion of the sealing portion to uncover at least one portion of the second portion of the opening, such that the interior of the ink chamber is in air communication with the exterior of the ink chamber via the at least one portion of the second portion of the opening, and wherein, when the protrusion is in the first position, the protrusion is positioned outside the case and extends away from and beyond the particular wall of the case.

2. The ink cartridge of claim 1, wherein when the protrusion is in the second position the predetermined portion of the protrusion is positioned within the case.

3. The ink cartridge of claim 1, wherein when the protrusion is in the first position the sealing portion and the protrusion prevent the interior of the ink chamber from being in air communication with the exterior of the ink chamber via the opening.

4. The ink cartridge of claim 1, wherein the protrusion is further configured to remain in the second position after the protrusion moves from the first position to the second position and the predetermined amount of force is released from the protrusion.

5. The ink cartridge of claim 1, wherein the protrusion is positioned between the predetermined portion of the sealing portion and a further portion of the sealing portion, a further portion of the protrusion is connected to the further portion of the sealing portion when the protrusion is in the first position, and the further portion of the protrusion is connected to the further portion of the sealing portion when the protrusion is in the second position.

6. The ink cartridge of claim 1, wherein the particular wall comprises a recessed portion, when the protrusion is in the first position the protrusion extends away from and is positioned outside the recessed portion, and when the protrusion is in the second position the predetermined portion of the protrusion is positioned within the recessed portion, such that the interior of the ink chamber is in air communication with the exterior of the ink chamber via the at least one portion of the second portion of the opening and the recessed portion.

7. The ink cartridge of claim 6, wherein at least a portion of the recessed portion comprises a semi-permeable film configured to allow air to pass therethrough and to prevent ink from passing therethrough.

8. The ink cartridge of claim 6, wherein the particular wall further comprises a raised portion connected to the recessed portion, and the opening is formed in the raised portion, wherein each of the sealing portion and the protrusion is positioned at the raised portion, and the recessed portion and the raised portion define an air chamber therein.

9. The ink cartridge of claim 1 further comprising an air chamber therein, wherein the case further comprise a first wall, and the particular wall is connected to the first wall, wherein the particular wall is substantially perpendicular to the first wall, and a predetermined portion of the particular wall defines the air chamber therein, wherein the predetermined portion of the particular wall has the opening formed therethough, wherein the ink supply portion is positioned at the first wall, wherein the protrusion is positioned at the predetermined portion of the particular wall, wherein when the protrusion is in the first position, the protrusion extends away from and is positioned outside the air chamber, and when the protrusion is positioned in the second position, the protrusion is positioned within the air chamber.

10. The ink cartridge of claim 9, wherein the protrusion is further configured to remain in the second position after the protrusion moves from the first position to the second position and the predetermined amount of force is released from the protrusion.

11. The ink cartridge of claim 9, wherein at least a portion the predetermined portion of the particular wall comprises a semi-permeable film configured to allow air to pass therethrough and to prevent ink from passing therethrough.

12. The ink cartridge of claim 9, wherein when the protrusion is in the first position the sealing portion and the protrusion prevent the interior of the ink chamber from being in air communication with the exterior of the ink chamber via the opening and the air chamber.

13. An ink supply system comprising:

the ink cartridge of claim 1;

a cartridge accommodating portion comprising:

an ink supply pipe, wherein the ink supply portion is configured to receive the ink supply pipe;

a sensor; and a contact portion, wherein when the ink cartridge is inserted into the cartridge accommodating portion the sensor is configured to detect the protrusion when the protrusion is in the first position, and the contact portion is configured to apply the predetermined amount of force to the protrusion to move the protrusion from the first position to the second position.

14. The ink supply system of claim 13, wherein the sensor is configured not to detect the protrusion when the protrusion is in the second position.

15. The ink supply system of claim 13, when the protrusion is in the second position the predetermined portion of the protrusion is positioned within the case.

16. The ink cartridge of claim 13, wherein when the protrusion is in the first position the sealing portion and the protrusion prevent the interior of the ink chamber from being in air communication with the exterior of the ink chamber via the opening.

17. The ink supply system of claim 13, wherein the protrusion is further configured to remain in the second position after the protrusion moves from the first position to the second position and the predetermined amount of force is released from the protrusion.

18. The ink supply system of claim 13, wherein the protrusion is positioned between the predetermined portion of the sealing portion and a further portion of the sealing portion, a further portion of the protrusion is connected to the further portion of the sealing portion when the protrusion is in the first position, and the further portion of the protrusion is connected to the further portion of the sealing portion when the protrusion is in the second position.

19. The ink supply system of claim 13, wherein the particular wall comprises a recessed portion, when the protrusion is in the first position the protrusion extends away from and is positioned outside the recessed portion, and when the protrusion is in the second position the predetermined portion of the protrusion is positioned within the recessed portion, such that the interior of the ink chamber is in air communication with the exterior of the ink chamber via the at least one portion of the second portion of the opening and the recessed portion.

20. The ink supply system of claim 19, wherein at least a portion of the recessed portion comprises a semi-permeable film configured to allow air to pass therethrough and to prevent ink from passing therethrough.

21. The ink supply system of claim 19, wherein the particular wall further comprises a raised portion connected to the recessed portion, and the opening is formed in the raised portion, wherein each of the sealing portion and the protrusion is positioned at the raised portion, and the recessed portion and the raised portion define an air chamber therein.

22. The ink supply system of claim 13, wherein the cartridge accommodating portion further comprises an accommodating case having a cartridge opening formed therethrough, wherein the cartridge opening is configured to receive the ink cartridge, the accommodating case comprises a rear wall opposite the cartridge opening, and the ink supply pipe extends from the rear wall towards the cartridge opening, wherein the ink supply portion comprises an ink supply valve, and the contact portion is configured to apply the predetermined amount of force to the protrusion when the protrusion is in the first position before the ink supply pipe opens the ink supply valve.

23. The ink supply system of claim 22, wherein a distance between the sensor and the cartridge opening is less than a distance between the cartridge opening and the rear wall, and the contact portion is positioned between the sensor and the rear wall.

24. An image recording apparatus comprising the ink supply system of claim 13.

* * * * *